United States Patent [19]

Von Doehren

[11] Patent Number: 4,785,489

[45] Date of Patent: Nov. 22, 1988

[54] RESILIENT BROOM AND SCRAPER

[75] Inventor: Edward P. Von Doehren, Fredericksburg, Iowa

[73] Assignee: Midwest Brush, Inc., Fredericksburg, Iowa

[21] Appl. No.: 103,266

[22] Filed: Oct. 1, 1987

Related U.S. Application Data

[63] Continuation-in-part of Ser. No. 904,959, Sep. 8, 1986, abandoned.

[51] Int. Cl.[4] ..... A46B 5/06; A46B 17/08

[52] U.S. Cl. ..... 15/111; 15/143 R; 15/144 R; 15/145; 15/159 R; 16/110 R; 403/229

[58] Field of Search ..... 15/143 R, 143 B, 144 R, 15/144 A, 144 B, 145, 146, 159 R, 176, 228, 244 R, 244 A, 111; 16/110 R, 114 R; 403/229, 287, 291

[56] References Cited

U.S. PATENT DOCUMENTS

| | | | |
|---|---|---|---|
| 843,590 | 2/1907 | Dunn et al. . | |
| 1,424,291 | 8/1922 | Frank . | |
| 1,896,843 | 2/1933 | Hall, Jr. | 15/144 R |
| 2,533,838 | 12/1950 | Ranft . | |
| 2,742,658 | 4/1956 | Sproston | 15/144 R |
| 2,929,087 | 3/1960 | Salmon . | |
| 3,016,556 | 1/1962 | Greenleaf | 15/144 A |
| 3,045,269 | 7/1962 | Coffman et al. . | |
| 3,051,976 | 9/1962 | Dubois et al. | 15/144 A |
| 3,084,369 | 4/1963 | Hawkins . | |
| 3,094,728 | 6/1963 | White | 15/145 X |

FOREIGN PATENT DOCUMENTS

| | | | |
|---|---|---|---|
| 494693 | 7/1950 | Belgium | 15/143 |
| 722367 | 12/1931 | France | 15/111 |
| 148432 | 10/1931 | Switzerland | 15/144 R |

*Primary Examiner*—Edward L. Roberts

*Attorney, Agent, or Firm*—Zarley McKee, Thomte, Voorhees & Sease

[57] ABSTRACT

This invention comprises a resilient broom and scraper comprising an elongated broom block having a top and bottom portion, with a brush secured to the lower portion thereof. A bracket is rigidly secured to the center of the top portion of the broom block. The bracket comprises a plate portion secured to the broom block, and has front and rear edges. A connecting flange extends upwardly and rearwardly from the rear edge of the plate portion and terminates in a tongue element. An elongated hollow coil spring with upper and lower ends is connected by its lower end to the connecting flange. The tongue element protrudes into the lower end of the coil spring. An elongated handle has its lower end frictionally inserted into the inner end of the coil spring. The front edge of the plate portion of the bracket terminates in a scraper plate which dwells in a parallel plane with respect to the connecting flange.

14 Claims, 1 Drawing Sheet

34
32
20
50
24
22
30
28
24
60
62

10
56
4
36
20
12
60
18
4

56
42
40
58
38
40A
36
34
48
32
44
52
54
46
50
20
42
36
40
48
40A
38
46
44
52
54

22
24
26
26
28
12
14
30
24
60
62
16
18

RESILIENT BROOM AND SCRAPER

This is a continuation-in-part of application Ser. No. 904,959, filed Sept. 8, 1986, now abandoned.

BACKGROUND OF THE INVENTION

Conventional brush brooms cannot easily be used to clean some restricted floor areas because the rigid connection between the handle and the broom head prevent the operator from placing the broom head at a proper sweeping angle to accommodate the restricted area. In addition, the handles of conventional brooms are often threaded at their lower ends and the handle is then screwed onto the head. This type of construction permits the two parts to become loosened with respect to each other to the annoyance and inconvenience of the operator. The threads cut in the wooden handle often cause it to be weakened and invite breakage.

In addition, injuries to the operator of conventional brooms has resulted when the broom head encounters a rigid object, thus causing the upper end of the broom handle to jab the broom operator.

Attempts have been made to create flexible connections between a handle and a mop-type device, but these connections are complicated, expensive, and are believed to be fragile in construction.

Similarly, brush brooms with scrapers thereon are complex, and often do not have sufficient support for substantial leverage to be exerted on the scraper element.

It is therefore a principal object of this invention to provide a brush broom with a handle means flexibly secured to the broom head wherein some angular displacement of the broom head with respect to the handle can be achieved by the operator.

A further object of this invention is to provide a brush broom with a handle means flexibly secured to the broom head wherein some angular displacement of the broom head with respect to the handle can be achieved by the operator, and wherein a scraper element is provided on the broom to permit the broom to be used for both scraping and sweeping.

A still further object of this invention is to provide a resilient connection between a brush broom and the handle therefor which is inexpensive of manufacture, but which is strong and durable in use.

A still further object of this invention is to provide a combination broom and scraper device wherein the scraper device is rigid with the broom head and is integrally connected with a connection flange secured to a resiliently mounted handle.

These and other objects will be apparent to those skilled in the art.

SUMMARY OF THE INVENTION

This invention comprises a resilient broom and scraper comprising an elongated broom block having a top and bottom portion, with a brush secured to the lower portion thereof. A bracket is rigidly secured to the center of the top portion of the broom block. The bracket comprises a plate portion secured to the broom block, and has front and rear edges. A connecting flange extends upwardly and rearwardly from the rear edge of the plate portion and terminates in a tongue element. An elongated hollow coil spring with upper and lower ends is connected by its lower end to the connecting flange. The tongue element protrudes into the lower end of the coil spring. An elongated handle has its lower end frictionally inserted into the upper end of the coil spring. The front edge of the plate portion of the bracket terminates in a scraper plate which dwells in a parallel plane with respect to the connecting flange.

DESCRIPTION OF THE PREFERRED EMBODIMENT

Figures 1, 2, 3, 4:
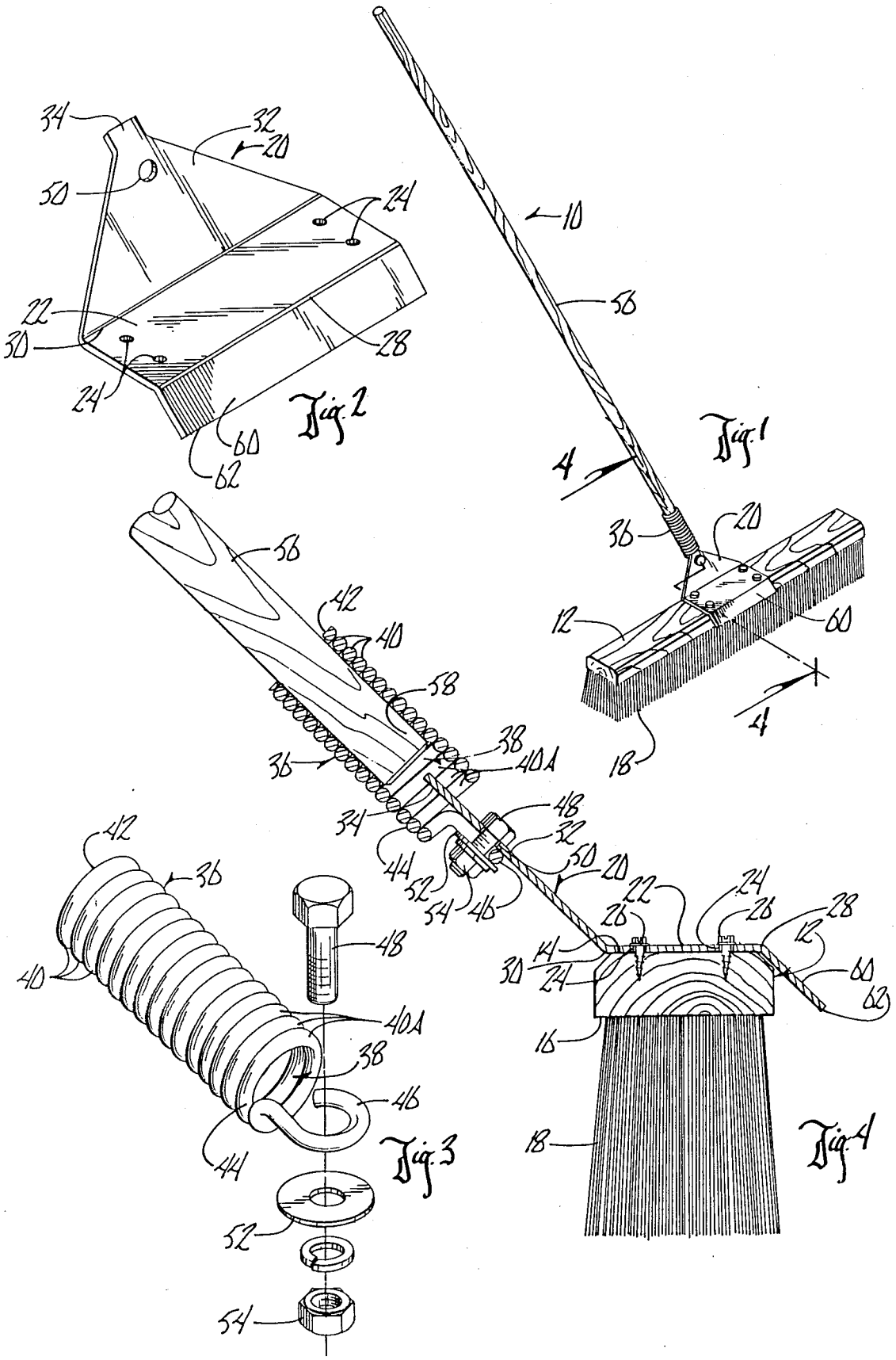
FIG. 1 is a perspective view of the resilient broom and scraper of this invention.
FIG. 2 is an enlarged scale perspective view of the bracket comprising a center plate portion, a scraper plate, and a connection flange.
FIG. 3 is an exploded perspective view of the spring of this invention which connects the handle and the broom head and scraper.
FIG. 4 is an enlarged scale sectional view taken on line 4—4 of FIG. 1.

The broom 10 comprises a broom block 12 having an upper surface 14 and a lower surface 26. A coventional broom brush 18 is secured to the lower surface 26 and extends downwardly therefrom.

A bracket 20 is comprised of plate 22 which dwells on the center of upper surface 14 of broom block 12. Apertures 24 in plate 22 are adapted to receive lag bolts 26 which extend through the apertures into the broom block 12 which is normally comprised of wood. Plate 22 has forward edge 28 and rearward edge 30.

Connecting flange 32 extends upwardly and rearward from rearward edge 30 of plate 22 as best shown in FIG. 4. The rearward end of connecting flange 32 terminates in tongue element 34. As seen in FIG. 2, the side edges of connecting flange 32 extend diagonally towards each other. The angle between plate 22 and connecting flange 32 is approximately 45°.

A coil spring 36 is comprised of a plurality of coils 40, and has an upper end 42 and a lower end 44. Lower end 44 terminates in an arcuate convolution 46 which dwells in a plane parallel to that of connection flange 32. A conventional bolt 48 extends through aperture 50 in connecting flange 32, and thence through the arcuate convolution 46 and is rigidly held in place through the cooperating efforts of washer 42 and nut 54. The nut 54 maintains the connection flange 32 and the arcuate convolution 46 in rigid engagement.

An elongated handle 56 having a lower end 58 is inserted into the upper end of the coil spring 36 as best shown in FIG. 4. Approximately 75% of the inner space of coil spring 36 is consumed by the lower end of handle 56. It should be noted that handle 56 is of constant diameter and no threads are cut into the lower end of the handle, which normally is comprised of wood.

The tongue 34 extends upwardly into the lower end 44 of coil spring 36, and is slightly spaced from the lower end of handle 56. The tongue 34 serves to limit the bending action of the handle with respect to the broom head as will be described hereafter.

A scraper plate 60 extends forwardly and downwardly from the forward edge 28 of plate 22 as shown in FIGS. 2 and 4. Scraper plate 60 has a scraper edge 62. Scraper plate 60 forms an angle of approximately 45° with respect to plate 22, and dwells in a plane substantially parallel to that of connection flange 32. Preferably, scraper plate 60, plate 22, connection flange 32, and tongue 34 are of metal and are of integral construction.

The numerals 40A designate the coils of coil spring 36 which exist below the lower end 58 of handle 56. Tongue element 34 dwells within coils 40A.

Typically, tongue 34 is approximately ½ inch in width and ⅜ inches in length. Typically, the internal diameter of coil spring 36 is 3¾ of an inch, and the outside diameter of handle 56 is 11/16th inches. Thus, as the lower end 58 of handle 56 is forcibly inserted into the upper end of coil spring 36, the spring expands in diameter to frictionally engage the lower end of the handle.

In operation, the operator can forcibly change the angle between the broom block 12 and the handle 56 by exerting pressure to flex the spring coils 40A. Tongue 34 serves to limit this flexing action so that damage to the respective parts will not occur. The connection flange 32 is at an appropriate angle to maintain a convenient operating angle between the handle and the broom head.

When it is desired to use the scraper plate 60, the broom head is inverted so that the scraping edge 62 of scraper plate 60 engages the floor surface to be scraped. The same flexing action of coils 40A can take place while the scraping operation is in process, but the greatest opportunity for flexure of the coils 40A is in the sweeping mode.

The device of this invention significantly adds to the versatility, safety, convenience, durability, and efficiency of manufacture of the disclosed apparatus. As a result, this invention achieves at least its stated objectives.

What is claimed is:

1. A broom device, comprising, an elongated broom block having a top and bottom portion, brush means secured to said bottom portion of said broom block and extending downwardly therefrom, a one-piece bracket rigidly secured to the center of said top portion of said broom block, said bracket comprising a flat plate portion secured to the top portion of said broom block, said plate portion having front and rear edges, a flat connecting flange extending upwardly and rearwardly from the rear edge of said plate portion, and terminating in a flat tongue element, said plate portion, connecting flange and tongue element being of integral construction, an elongated hollow coil spring having upper and lower ends and connected by its lower end to said connecting flange, said tongue element protruding into the lower end of said coil spring, and an elongated handle having a lower end frictionally inserting into the upper end of said coil spring.

2. The device of claim 1 wherein said coil spring has a spring convolution at its lower end formed into an arcuate portion dwelling in a plane parallel to that of said connecting flange, said arcuate portion engaging said connecting flange, and connection means rigidly connecting said connection flange and said arcuate portion.

3. The device of claim 1 wherein the lower end of said handle is of uniform constant diameter.

4. The device of claim 1 wherein said tongue element is spaced from the lower end of said handle.

5. The device of claim 1 wherein said front edge of said plate portion terminates in a scraper plate.

6. The device of claim 5 wherein said scraper plate, said plate portion, and said connecting flange are of integral construction.

7. The device of claim 5 wherein said scraper plate and said connection flange dwell in parallel planes.

8. The device of claim 5 wherein said coil spring has a spring convolution at its lower end formed into an arcuate portion dwelling in a plane parallel to that of said connecting flange, said arcuate portion engaging said connecting flange, and connection means rigidly connecting said connection flange and said arcuate portion.

9. The device of claim 5 wherein the lower end of said handle is of uniform constant diameter.

10. The device of claim 5 wherein said tongue element is spaced from the lower end of said handle.

11. A broom device, comprising, an elongated broom block having a top and bottom portion, brush means secured to said bottom portion of said broom block and extending downwardly therefrom, a one-piece bracket rigidly secured to the center of said top portion of said broom block, said bracket comprising a flat plate portion secured to the top portion of said broom block, said plate portion having front and rear edges, a flat connecting flange extending upwardly and rearwardly from the rear edge of said plate portion, and terminating in a flat tongue element, said plate portion, connecting flange and tongue elements being of integral construction;

a resilient connector means having hollow upper and lower ends and connected by its lower end to said connecting flange, said tongue element protruding into the lower end of said connector means, and an elongated handle having a lower end frictionally inserted into the upper end of said connector means.

12. The device of claim 11 wherein said front edge of said plate portion terminates in a scraper plate.

13. The device of claim 12 wherein said scraper plate, said plate portion, and said connecting flange are of integral construction.

14. The device of claim 12 wherein said scraper plate and said connection flange dwell in parallel planes.

* * * * *